United States Patent [19]

Stowik et al.

[11] 4,080,764

[45] Mar. 28, 1978

[54] DOOR JAMB WITH ISOLATED HEAT STRIP

[75] Inventors: William J. Stowik, Hudson; Kenneth L. Kaiser, North Hudson, both of Wis.

[73] Assignee: The Vollrath Company, Sheboygan, Wis.

[21] Appl. No.: 699,717

[22] Filed: Jun. 25, 1976

[51] Int. Cl.[2] ..... F25D 21/06

[52] U.S. Cl. ..... 52/173 R; 62/275

[58] Field of Search ..... 62/275; 49/475; 220/9 G; 219/531, 538; 52/173, 309.11

[56] References Cited

U.S. PATENT DOCUMENTS

| | | | |
|---|---|---|---|
| 2,135,091 | 11/1938 | Newill | 62/275 |
| 2,725,271 | 11/1955 | Cunningham | 220/96 |
| 2,731,804 | 1/1956 | Grubbs | 62/275 |
| 2,896,271 | 7/1959 | Kloote | 52/309.9 |
| 3,110,158 | 11/1963 | Kuhn | 62/275 |
| 3,869,873 | 3/1975 | Thomas | 62/275 |

*Primary Examiner*—John E. Murtagh

*Attorney, Agent, or Firm*—Dressler, Goldsmith, Clement, Gordon & Shore, Ltd.

[57] ABSTRACT

A novel door jamb having an isolated heat strip in which the surface to be contacted by the door is made of a re-enforced fiberglass material which has high impact resistance, superior chemical and corrosion resistance, will not easily scratch, and can be readily repaired. Secured to the fiberglass section of the door jamb is an isolated heat strip material requiring a low wattage, which functions to keep the door gasket pliable allowing it to seal tightly to the jamb and thus eliminate any chance of frost buildup on the jamb due to outside air leakage by the gasket.

2 Claims, 2 Drawing Figures

DOOR JAMB WITH ISOLATED HEAT STRIP

BACKGROUND OF THE INVENTION

Figure 1:
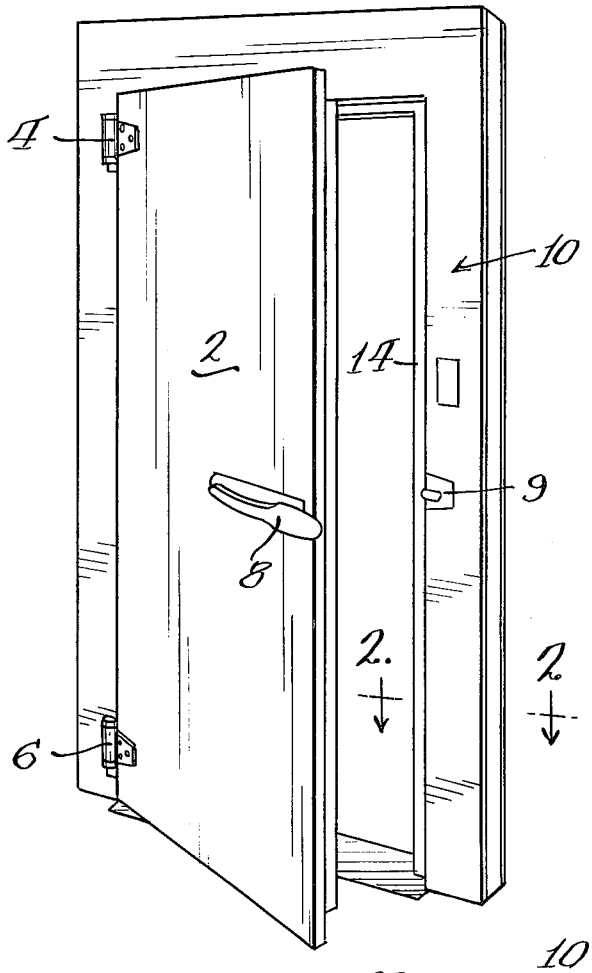

In door jambs heretofore used with low-temperature compartments, such as, commercial walk-in coolers and freezers, they have typically been made of a metallic material the use of which gives rise to a number of disadvantages. Such materials as aluminum and steel scratch easily, have a tendency to rust, or corrode, and due to their high thermal conductivity require a large input of heat in order to maintain the door gaskets used with the doors in a good sealing relationship and prevent condensation from forming around the perimeter of the door opening. Obviously, if the door seal is not maintained, there could result a substantial frost build-up due to outside air leakage. For example, it has heretofore been found that in order to maintain the requisite sealing conditions at the door jamb and condensation, free condition around the door opening perimeter, there has been required an input on the order of 10 watts per foot in order to insure that the door sealing gaskets are maintained sufficiently pliable to maintain a satisfactory seal where metal door jambs have been used and at the same time keep the outside perimeter of door opening at room temperature, or slightly higher, in order to prevent condensation. This is necessary to maintain adequate heat in the contact areas due to the rapid dissipation of heat through the metal. In addition to this, of course, due to the high thermal conductivity of metal, there is the substantial transfer of heat to the internal area of the cooler, or freezer, which requires additional cooling action within the low-temperature compartment to retain the cooler or freezer at the requisite temperature.

In accordance with the present invention, there is provided a door jamb that has an exterior surface made of a reenforced fiberglass material which has a high impact resistance on the order of 25 times that of an equal section of aluminum and more than 16 times that of steel. The fiberglass material does not scratch easily, but even if scratched, due to the total impregnation of color, the scratches are not readily apparent. Of very significant importance is that fiberglass has a low thermal conductivity.

Furthermore, in the event of damage to the fiberglass, it can be easily repaired by the utilization of body putty. This material is very rugged and durable and employs a thermoset resin in its manufacture. In this way, the material will not crack when it gets cold, or melt when it gets too warm. Similarly, it will obviously not rust or corrode, or degrade over the years, as some other materials have a tendency to do.

Other advantages include the reduction of weight resulting from the use of fiberglass without sacrifice to the strength and dimensional stability of the door section. Also, this material selection permits the use of steam cleaning without worry of melting or deformation, as would be the case if a thermal plastic material was used.

When a door jamb of the aforementioned type is used, due to its low thermal conductivity, there need only be employed a heater strip isolated by the door jamb from any metallic portion of the cooler or freezer consisting of a heater wire for maintaining the requisite conditions for door sealing that consumes electric power on the order of 2 watts per foot, as compared with 10 watts per foot, when one uses a metal door jamb.

On a yearly basis, the savings due to the need to only require a very low wattage in the isolated heater strip, combined with the reduced amount of heat transmitted to the inside of the cooler, are as much as $100.00 per year in electrical costs for every 36 × 78 inch door provided on a walk-in cooler, or freezer.

Figure 2:
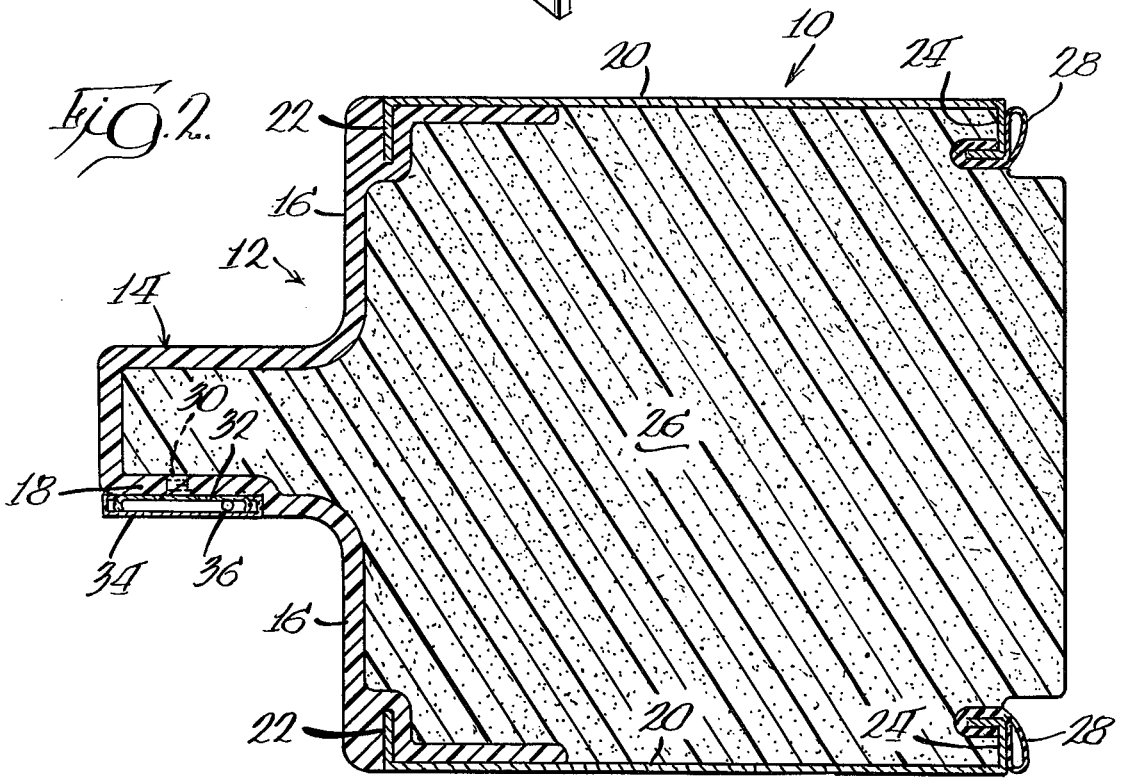

Other advantages will be apparent from the following description of the invention, as illustrated in the attached drawings, in which:

FIG. 1 is a perspective view of a door jamb showing a door in an open position; and FIG. 2 is a cross-sectional view of the door jamb taken along line 2—2 of FIG. 1.

Referring now to FIG. 1, it is seen that there is illustrated a door 2 shown in the open position and hinged to a door jamb by hinges 4, 6. The door is moved relative to the door jamb by a handle 8 which is positioned to be engaged with a latch 9 secured to the door jamb 10.

The cross-sectional view of the door jamb 10, as shown in FIG. 2, is generally T-shaped in configuration and includes a front portion 12 made up of leg 14 and sidewalls 16 disposed on opposite sides of the leg 14. In accordance with the present invention, the front portion 12 is constructed of a fiberglass material. Secured to the wall 18 of the jamb leg 14 is a heater strip which will be described hereinafter.

The remainder of the door jamb consists of sidewalls 20 having flanges 22 and 24 extending inwardly, which sidewalls, constructed of an appropriate material, and fiberglass cap 12 contain insulating material 26, such as, a rigid polyurethane foam. At the back end of the door jamb are gaskets 28, which aid in providing a sealing relationship to minimize leakage when the door jamb is inserted into position.

As previously discussed, it is necessary to provide a heater assembly in that portion of the door jamb to be contacted by the door sealing gasket in order to insure that the gasket will be maintained sufficiently pliable to perform the necessary sealing function when the door 2 is closed. To this end, it is required to provide a localized heat source which will maintain the sealing gasket in the requisite condition, which source will be sufficiently small to accomplish its functions, and substantially minimize the dissipation of heat which would otherwise incur several obvious disadvantages. These disadvantages include: (1) the need to provide a much larger source of heat than is otherwise needed to make up for the rapid dissipation of heat and (2) in the case of the door jamb being used for a cooler, or freezer, to prevent the dissipation of heat into the interior of the cooler, or freezer, which will thereby require still additional power to maintain the prescribed temperature within the cooler, or freezer.

In accordance with this invention, there is employed a heater strip which is secured to the fiberglass jamb portion, which heater strip is thereby isolated from the interior of the cooler, or freezer, and the other surrounding area by attaching it to the fiberglass material 12, which has a very low thermal conductivity. Thus, the heat source will remain localized and not have the disadvantages referred to above. Specifically, the isolated heat strip assembly, as shown in FIG. 2, is secured to the wall 18 of the leg 14 by rivets 30 and consists of a pair of interengaging channel members 32, 34. The channel member 34 is designed to slide relative to the channel member 32 to permit relative movement there-between and thus facilitate insertion of heater wire 36, which is connected to a suitable source of power to conduct heat to the heater strip assembly to insure that the sealing gasket to the door 2 will remain pliable and thus serve to eliminate any chance of frost buildup on the jamb due to outside air leakage, While is is seen that there is employed a T-shaped configuration of a particular design, it is, or course, intended to cover by the appended claims all such configurations as would fall within the scope thereof. Specifically, it is an object of this invention to provide a novel door jamb assembly made of a re-enforced fiberglass material that has high impact resistance, will not crack due to cold air, melt when subjected to heat, has dimensional stability, and low thermal conductivity, while at the same time having all the attributes of door jambs previously employed.

What is claimed is:

1. A jamb assembly for a door having a sealing gasket closing off a sealed low temperature compartment having a generally T-shaped configuration in which the leg of said jamb and its adjacent surfaces are constructed of a reinforced fiberglass material and the majority of the balance thereof is a foam material, said jamb leg including an exposed surface positioned to be contacted by the door in its closed position, said exposed surface having a recess therein, which jamb assembly will not rust or corrode, and its also sufficiently rugged and durable, so that it will not crack when it gets cold, or melt when it gets too warm, the assembly further includes an isolated heat strip assembly consisting of a metallic enclosure secured within the recess of said exposed surface the outer surface of said enclosure being flush with the exposed surface of said leg, a heater wire requiring very low wattage extending through said enclosure, said heater wire serving to aid in maintaining the sealing relationship between the door and jamb assembly and at the same time to eliminate any chance of frost buildup on the jamb due to outside air leakage.

2, A jamb assembly in accordance with claim 1 in which the complete leg of said jamb and the entire undersurface of said T surface adjacent the leg is composed of laminated glass reinforced material.

* * * * *